US008517866B2

(12) United States Patent
Williams

(10) Patent No.: US 8,517,866 B2
(45) Date of Patent: Aug. 27, 2013

(54) TRAINING BAT

(76) Inventor: Larry W. Williams, Hewitt, TX (US)

( * ) Notice: Subject to any disclaimer, the term of this patent is extended or adjusted under 35 U.S.C. 154(b) by 266 days.

(21) Appl. No.: 13/212,730

(22) Filed: Aug. 18, 2011

(65) Prior Publication Data

US 2012/0046135 A1 Feb. 23, 2012

Related U.S. Application Data

(60) Provisional application No. 61/344,548, filed on Aug. 18, 2010.

(51) Int. Cl.
*A63B 69/00* (2006.01)

(52) U.S. Cl.
USPC ..... 473/457

(58) Field of Classification Search
USPC ..... 473/519, 457, 526, 549, 552, 564, 473/568, 424, 567; 29/451; 463/47.2
See application file for complete search history.

(56) References Cited

U.S. PATENT DOCUMENTS

| | | | | |
|---|---|---|---|---|
| 143,610 | A | | 10/1873 | Beery et al. |
| 310,248 | A | | 1/1885 | Brown |
| 503,977 | A | | 8/1893 | Nelson |
| 875,273 | A | | 12/1907 | Kimble |
| 897,201 | A | | 8/1908 | Gannon |
| 1,063,563 | A | | 6/1913 | May |
| 1,325,813 | A | | 12/1919 | Taylor, Jr. |
| 1,665,195 | A | | 4/1928 | Cohn |
| 1,986,682 | A | | 1/1934 | Schulz |
| 2,099,521 | A | | 11/1937 | Herkimer |
| 3,136,546 | A | | 6/1964 | Connolly |
| 3,336,029 | A | * | 8/1967 | London ..... 463/47.2 |
| 3,543,715 | A | * | 12/1970 | Hill ..... 116/67 R |
| 3,578,801 | A | | 5/1971 | Piazza |
| 3,841,130 | A | * | 10/1974 | Scott et al. ..... 72/70 |
| 4,032,143 | A | * | 6/1977 | Mueller et al. ..... 473/567 |
| 4,343,467 | A | | 8/1982 | Newcomb et al. |
| 4,555,111 | A | | 11/1985 | Alvarez |
| 4,763,899 | A | | 8/1988 | Hundley |
| 5,516,097 | A | | 5/1996 | Huddleston |
| 6,254,502 | B1 | | 7/2001 | Becker |
| 6,280,353 | B1 | | 8/2001 | Brundage |
| 6,669,584 | B1 | * | 12/2003 | Miller ..... 473/568 |
| 6,767,299 | B1 | | 7/2004 | Chang |
| 6,875,137 | B2 | * | 4/2005 | Forsythe et al. ..... 473/566 |
| 6,918,843 | B1 | * | 7/2005 | Franssen ..... 473/457 |
| 6,949,036 | B2 | * | 9/2005 | Ciesar et al. ..... 473/457 |
| 7,198,581 | B1 | * | 4/2007 | Black ..... 473/454 |
| 7,261,654 | B2 | * | 8/2007 | Cheng ..... 473/457 |
| 7,320,653 | B2 | * | 1/2008 | Fitzgerald et al. ..... 473/566 |
| 7,399,242 | B1 | | 7/2008 | Smith |
| 8,187,124 | B2 | * | 5/2012 | Ciesar et al. ..... 473/457 |
| 8,246,495 | B2 | * | 8/2012 | James ..... 473/451 |

(Continued)

*Primary Examiner* — Gene Kim
*Assistant Examiner* — M Chambers
(74) *Attorney, Agent, or Firm* — Stein IP, LLC

(57) ABSTRACT

A training bat for use by athletes to practice hitting in preparation for baseball and softball games. Bat comprises a barrel, a handle, an enlarged head at the end of bat remote from the handle, with a bore extending longitudinally through bat. A first weight is located at the lower end of the bore, and a rubber hose abuts the first weight. A second, larger weight extends through the enlarged head, and abuts the upper end of the hose. An impact absorbing material, such as rubber, is molded about the exterior of the bat. The bat, when swung, flexes in the area of the rubber hose. When used repeatedly, the training bat "works" the wrists, forearm, and back muscles of the hitter.

9 Claims, 2 Drawing Sheets

(56) References Cited

U.S. PATENT DOCUMENTS

2006/0258490 A1* 11/2006 Fitzgerald et al. ..... 473/564
2007/0202968 A1* 8/2007 Zappel et al. ..... 473/424
2011/0034275 A1* 2/2011 Kim ..... 473/457
2012/0046135 A1* 2/2012 Williams ..... 473/457

* cited by examiner

TRAINING BAT

CROSS-REFERENCE TO RELATED APPLICATIONS

This application claims the benefit of U.S. Provisional Application No. 61/344,548, filed Aug. 18, 2010, in the U.S. Patent and Trademark Office, the disclosure of which is incorporated herein by reference.

BACKGROUND OF THE INVENTION

1. Field of the Invention

The invention pertains to a training bat, formed of a moldable material, such as rubber, and reinforced by steel inserts. The bat is used for practice swings, while a batter is "loosening up" for a baseball or softball game.

2. Description of the Related Art

Baseball or softball players loosen up, or warm up, in the on-deck circle, by taking practice swings with a bat. A weighted collar, or doughnut, is slipped over the bat prior to swinging same. The weighted collar can slip off the bat when the bat is swung vigorously, thus creating a potential safety hazard. Also, there is usually no flexibility in the bat, so that the extra weight may lead to injury of the muscles, tendons, or ligaments of the player swinging the rigid bat.

An alternative practice bat is shown in U.S. Pat. No. 4,763,899, granted to W. Maynard Hundley. The alternative bat is formed from a moldable plastic resin with an integrally molded weight, preferably of lead, at an outer portion, and a stiffening device, such as aluminum tubing, at an inner end. The bat resembles a standard wooden bat in shape. The bat is, however, characterized by a flexible intermediate portion typically formed of a standard steel cable. The intermediate portion has sufficient resiliency to bend, and discharge substantial amounts of inertial energy at the end of a swing, thus preventing injury to the user. Bats of this type were sold under the mark, WHIP-O warm-up bat, by the Mayco Company of Grand Rapids, Mich.

Numerous other practice bats have been devised. To illustrate, U.S. Pat. No. 4,555,111, granted Nov. 26, 1985 to Manuel R. Alvarez, discloses a practice bat for baseball players including a handle portion (12) and a weighted end portion (16) interconnected by a resilient spring (14). The weighted end portion is remote from the hands of the player holding the handle portion, as shown in FIGS. 1A-1C. Consequently, when the bat is swung, the momentum of the weighted end portion will cause it to lag behind, as shown in FIG. 3, and than move ahead, of a longitudinal, at rest axis, of the handle portion, thereby causing the player's wrists to break or bend.

U.S. Pat. No. 7,399,242, granted Jul. 15, 2007 to Douglas Smith, discloses a weighted training bat (10) formed of wood having a handle (14) and a barrel (12). The barrel has an elongated hollow cavity (28) formed into a distal end thereof, and an outer portion cavity portion having internal threads (22). Lead (26) fills the proximal portion of the cavity. When solidified, the lead adheres to the interior surface of the cavity to resist loosening the lead adding weight and located astride the "sweet spot (36)" of the bat. An elongated wooded screw (20), having external threads, is tightly engaged into internal threads in the cavity so the screw bears against the lead to prevent further loosening of the lead.

However, most of the known training bats were relatively complicated to manufacture and assemble, and thus were costly to purchase. Also, many of the known training bats were made with a wooden body with a longitudinal bore that weakened the structural integrity of the bat, and caused breakage or fracture. Many of the known training bats employed a lead slug located at the free end of the bat, with attendant increases in cost.

SUMMARY OF THE INVENTION

The present invention is a training, or warm-up, bat, employing an enlarged head at its free end. A larger weight is located in the enlarged head, and a smaller weight is located in a hollow bore extending away from the handle. A length of flexible material, such as a rubber hose, is located in the interior of the barrel of the bat, in between the handle and the head. The bat, when swung, tends to flex, while strengthening the muscles of the batter.

The present invention is formed as a rubber molding, with the components retained in a central bore that extends longitudinally from the handle to the enlarged head of the bad. The rubber body does not scuff or abrade, and effectively absorbs the repeated impact of the bat against a baseball, softball, or, a tennis ball or a rubber or plastic ball. Training bats made of wood, particularly those with a central bore extending longitudinally throughout the length of the bat, may fracture or splinter, causing a potential safety hazard.

Also, the present invention may be molded in different sizes, such as 29, 31 and 33 inches, to allow athletes of different ages and physical characteristics to utilize same. To illustrate, applicant's training bat is suitable for girl's softball, Little League baseball, high school and college athletics, as well as professional athletics. The weights inserted into the bore of the training bat may be three pounds, four pounds, or five pounds, depending upon the size of the batter.

Lastly, the present invention is directed to a sturdy training bat with along service life. The bat provides weight resistance for a complete range of motion for the batter, to train, and develop, certain muscles within the batter's body. To illustrate, the training bat works the batter's back muscles, forearms, and wrist muscle. Regular, and repetitive, use of the training bat leads to increased bat speed, minimizes one's reaction time to a ball being pitched, helps the batter keep his, or her, "hands back" when swinging, and assists one with proper follow-throughs.

BRIEF DESCRIPTION OF THE DRAWINGS

These and/or other aspects and advantages of the invention will become apparent and more readily appreciated from the following description of the invention, taken in conjunction with the accompanying drawings of which.

DETAILED DESCRIPTION OF THE EMBODIMENTS

Figure 1:
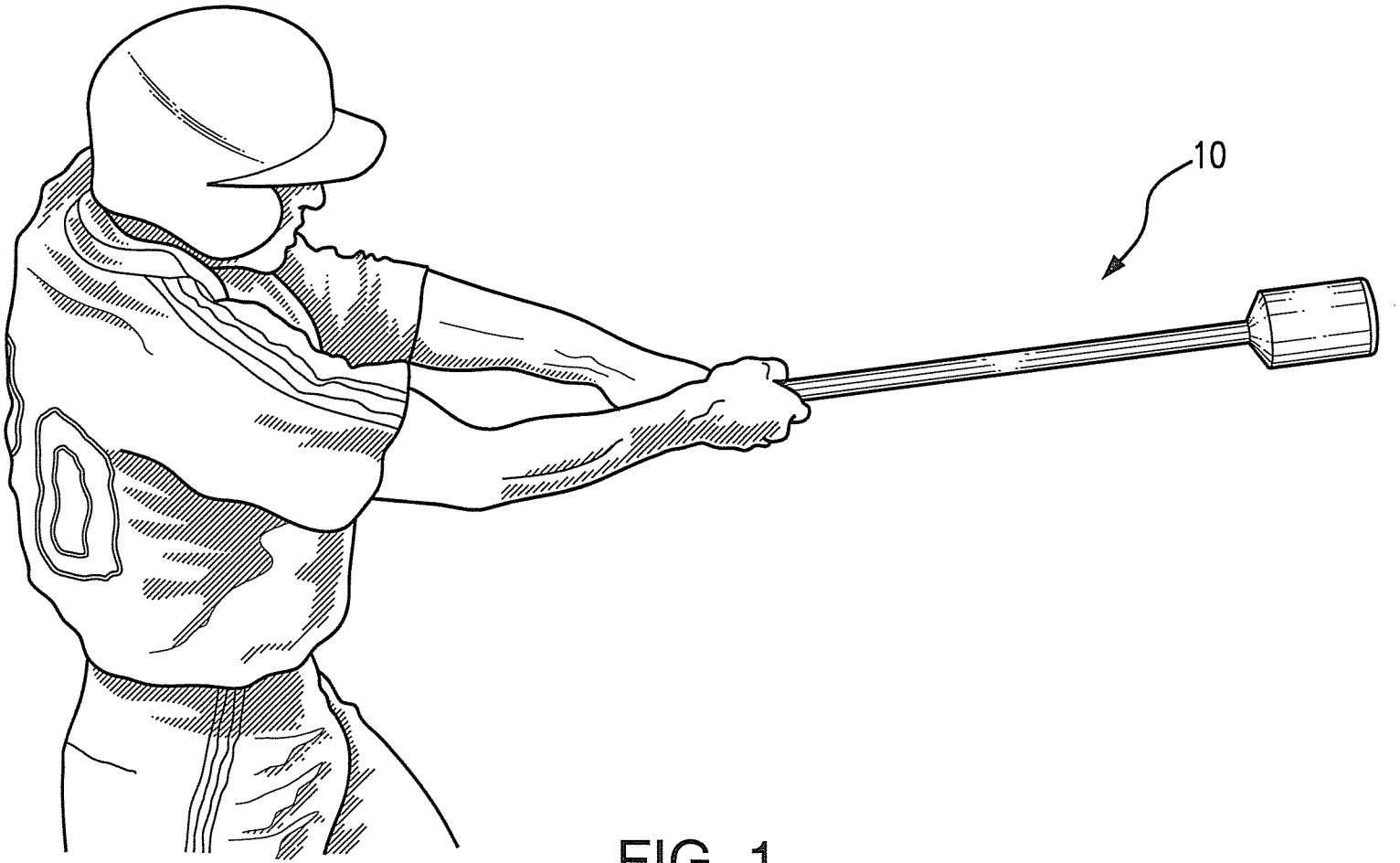
FIG. 1 is a perspective view of a batter swinging applicant's training bat.
Figure 2:
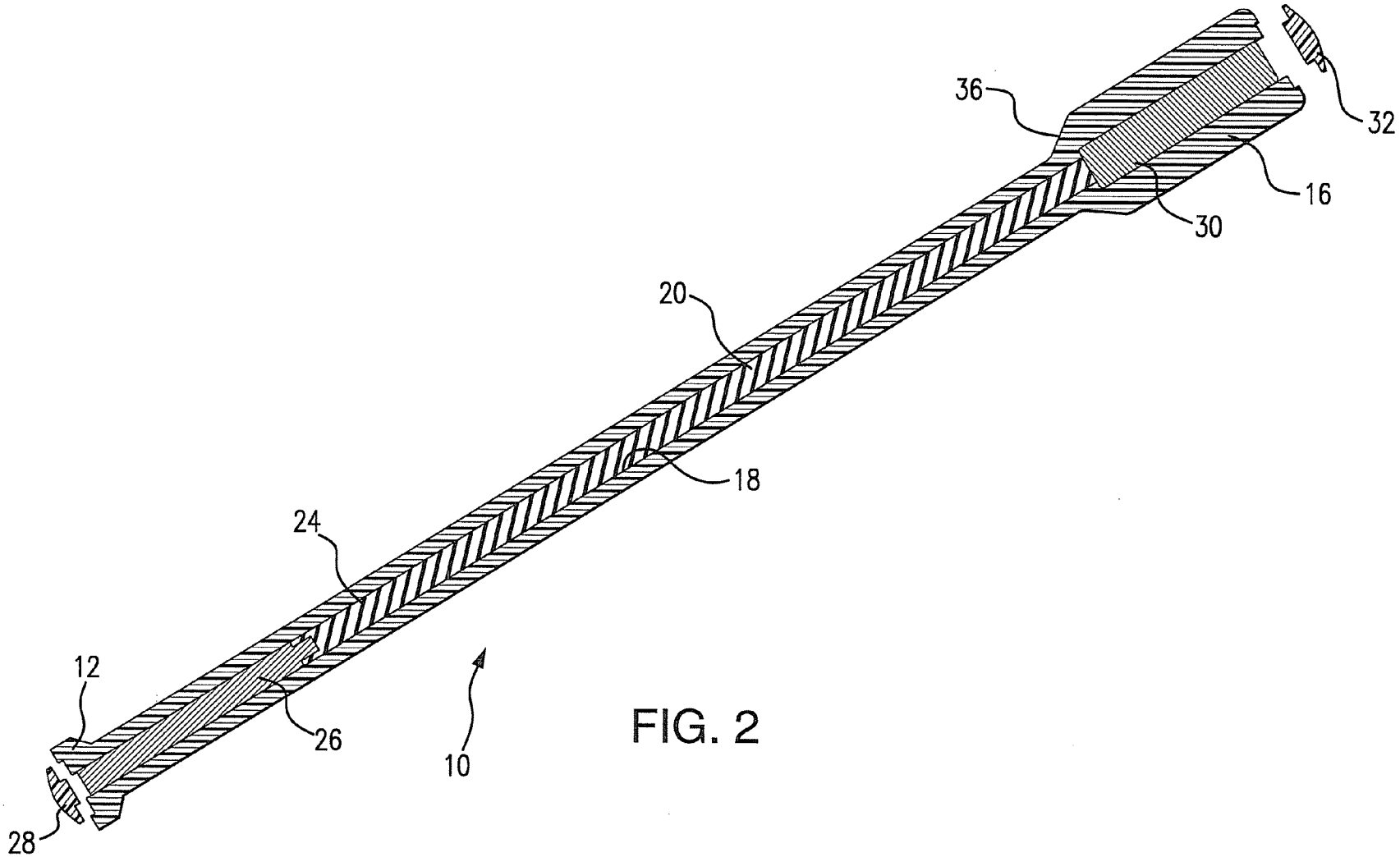
FIG. 2 is a cross-sectional view of applicant's training bat.

A training bat, embodying the principles of applicant's invention, is identified, generally, by reference numeral 10, in FIGS. 1 and 2. FIG. 1 shows a ball player warming up, prior to entering a baseball game, by swinging training bat 10.

The components of training bat 10 are shown in the longitudinal, cross-sectional view of FIG. 2. Bat 10 comprises a handle or knob 12 at its lower end, a cylindrical barrel 14, and an enlarged head 16. Bore 18 extends longitudinally through the bat from the bottom of the handle to the top of the enlarged head along a central axis, and is open at its opposite ends.

An elongated length of rubber hose 20 is slipped into bore 18, and is located between a first weight in the handle and a second larger weight in enlarged head 16. The first metal weight 26 is inserted into bore 18 and a plug 28 seals the bottom end of bore 18.

First metal weight 26 abuts rubber hose 20. The second metal weight 30 is located at the upper end of bore 18, in enlarged head 16 and a second plug 32 seals the open, upper end of bore 18. Second weight 30 is approximately one and a half times greater than the first weight 26. In a preferred embodiment of applicant's bat, weight 30 is one inch in diameter and four and a half inches in length, and weighs one pound. In contrast, weight 26 is one-half inch in diameter, twelve inches in length, and weighs two-thirds of a pound. Weights 26 and 30 are formed of steel rods.

A gradually tapering shoulder 36 extends between the upper end of barrel 14 and enlarged head 16. The enlarged head 16 surrounds second weight 30, and the head is substantially larger than the diameter of barrel 14 of bat 10. A second rubber plug 32 retains weight 30 with its proper position in enlarged head 16.

Body 14 of the applicant is formed of rubber, or a rubberized material. Body 14 is molded over the components located in bore 18, so that the bat can be manufactured at a reasonable price, and can be made in different lengths with different weights for players of all ages. The swinging of the bat improves bat speed, and trains the skeletal muscles of the users, which control and move the bones of the human body. The swinging of the bat also turns, and works, the tendons and ligaments of the user, to enhance the flexibility of the batter, and his quickness in responding to a pitch. The bat is flexible in the area about rubber hose 20, so that the bat flexes during its stroke.

Bat 10 may be molded in different lengths, such as 27 inches, 30 inches, and 33 inches, for users in Little League games or girl's softball, high school competition, college, and professional athletics. Weights of different magnitude may be used in the bats, depending upon the age and size of the batter, such as three pounds, four pounds, and five pounds. The bats are used for batting practice for baseball or softball.

A preferred embodiment of training bat 10 has been described in detail. However, refinements and modifications in the bat may occur to the skilled artisan. Consequently, the appended claims should be broadly construed in a manner consistent with applicant's contribution to the development of a versatile, reasonably priced, training bat that is capable of a long, useful life. The claims should not be limited by their literal terms.

The invention claimed is:

1. A training bat for use in training athletes for hitting in baseball and softball games, said bat comprising:

a) a barrel, b) a handle at one end of said barrel, c) an enlarged head at the opposite end of said barrel, d) a bore extending through the interior of said bat from said grip through said enlarged head, e) a first weight located in said handle of said bat, f) a length of rubber hose inserted into said bore in adjunct to said first weight, g) and a second weight inserted located in said enlarged head of said bat, h) said second weight in said enlarged head is greater than said first weight, in said handle, whereby said bat flexes as said bat is swung and wherein said bat is molded with an impact resistant body which encases said bore, the length of rubber hose, and said first and second weights located within said bore.

2. The training bat as defined in claim 1, wherein plugs are used to seal the opposite ends of said bore.

3. The training bat as defined in claim 1 wherein said enlarged head is significantly larger than the diameter of said barrel.

4. The training bat as defined in claim 1 wherein said second weight is one and a half times greater than said first weight.

5. The training bat as defined in claim 1 wherein a shoulder is formed at the intersection of said enlarged head and said cylindrical barrel.

6. The training bat as defined in claim 1 wherein said bat flexes in the vicinity of said length of rubber hose as said bat is swung by a user.

7. The training bat as defined in claim 1 wherein a tapered shoulder is formed at the intersection of said enlarged head and said barrel of said bat.

8. The training bat as defined in claim 1 wherein said barrel is cylindrical in shape, and said handle is greater in diameter than said barrel.

9. The training bat as defined in claim 1 wherein said weights are formed by metal rods.

* * * * *